US010986928B2

(12) United States Patent
Dumont

(10) Patent No.: US 10,986,928 B2
(45) Date of Patent: Apr. 27, 2021

(54) STEP STOOLS AND STORAGE, STEP SUPPORTS HAVING OPEN, FORWARDLY-FACING STORAGE CUBBIES

(71) Applicant: Bertrand F. Dumont, Bayshore, NY (US)

(72) Inventor: Bertrand F. Dumont, Bayshore, NY (US)

( * ) Notice: Subject to any disclaimer, the term of this patent is extended or adjusted under 35 U.S.C. 154(b) by 465 days.

(21) Appl. No.: 14/716,484

(22) Filed: May 19, 2015

(65) Prior Publication Data

US 2016/0338496 A1 Nov. 24, 2016

(51) Int. Cl.
*A47B 83/00* (2006.01)
*A47C 12/00* (2006.01)

(52) U.S. Cl.
CPC ..... *A47C 12/00* (2013.01)

(58) Field of Classification Search
CPC ..... E05C 1/005; A47C 12/00; A47C 12/02; A47B 2220/05; A47B 83/00
See application file for complete search history.

(56) References Cited

U.S. PATENT DOCUMENTS 676,157 A * 6/1901 Sparks ..... A47F 3/00 312/119
927,625 A * 7/1909 Woldridge ..... A47F 3/005 312/126
927,671 A * 7/1909 Nicholson ..... A47F 3/00 211/55
1,447,145 A 2/1923 Morell
2,269,878 A 1/1942 Kimball
4,139,077 A 2/1979 Pena, Jr.
4,934,113 A * 6/1990 Hall ..... E04H 3/28 182/223
5,352,031 A 10/1994 Nahrgang
5,735,586 A * 4/1998 Cheng ..... A47B 46/00 182/35
D404,214 S * 1/1999 Zaidman ..... D6/384
6,338,535 B1 * 1/2002 Rickert ..... A61J 7/0084 312/234.1
6,378,720 B1 4/2002 Kneier
6,948,777 B2 * 9/2005 Marshall ..... A47C 7/52 297/423.2
7,240,381 B1 * 7/2007 Hawse ..... A47C 17/161 5/18.1
8,540,326 B2 9/2013 Moszer
8,567,615 B1 10/2013 Rainey
2002/0060491 A1 5/2002 Kneier
2008/0164724 A1 7/2008 Burnett et al.
2008/0264723 A1 10/2008 Tatum et al.
2009/0039747 A1 2/2009 Webster, II et al.
2010/0068026 A1 * 3/2010 Brewer, III ..... G03G 15/6552 414/749.6
2011/0247898 A1 * 10/2011 Wigutoff ..... E04G 1/28 182/223
(Continued)

*Primary Examiner* — Matthew W Ing
(74) *Attorney, Agent, or Firm* — Daniel P. Burke & Associates, PLLC; Daniel P. Burke; Georgia Damoulakis

(57) ABSTRACT

Step stools and storage, step supports having open, forwardly-facing storage cubbies for use in confined spaces, such as closets. Some of the storage, step supports have steps which are fixed relative to other steps while other storage, step supports are provided with one or more relatively movable steps and are movable from a storage position to a step position.

22 Claims, 15 Drawing Sheets

(56) References Cited

U.S. PATENT DOCUMENTS

| | | | | |
|---|---|---|---|---|
| 2012/0234630 | A1* | 9/2012 | Havens | A47C 12/00 182/223 |
| 2015/0090528 | A1* | 4/2015 | Binegar | A47C 12/00 182/12 |

* cited by examiner

STEP STOOLS AND STORAGE, STEP SUPPORTS HAVING OPEN, FORWARDLY-FACING STORAGE CUBBIES

Step stools and storage, step supports having open, forwardly-facing storage cubbies for use in confined spaces, such as closets, are disclosed. Some embodiments comprise movable lower steps which are extendable to facilitate stepping up and retractable to minimize the overall foot print of the step stool, while providing storage space and permitting access to stored items in any position.

BACKGROUND

The ability to maximize storage capacity in a confined space, such as a closet, is often desirable. Storing items in a closet can entail storing the items at a height which is not readily reachable by a person of average height. It is also desirable to have ready access to items which are stored within reach.

DETAILED DESCRIPTION

Stable, sturdy step stools and storage step supports which advantageously comprise storage cubbies having open, forwardly facing openings for allowing access to stored items, such as shoes, in confined spaces such as closets are disclosed. The various embodiments illustrated and described herein provide convenient and orderly storage for items such as shoes in a manner which increases storage capacity in confined spaces such as closets while simultaneously providing the ability to readily access other items stored above the unaided reach of the user.

Figure 1:
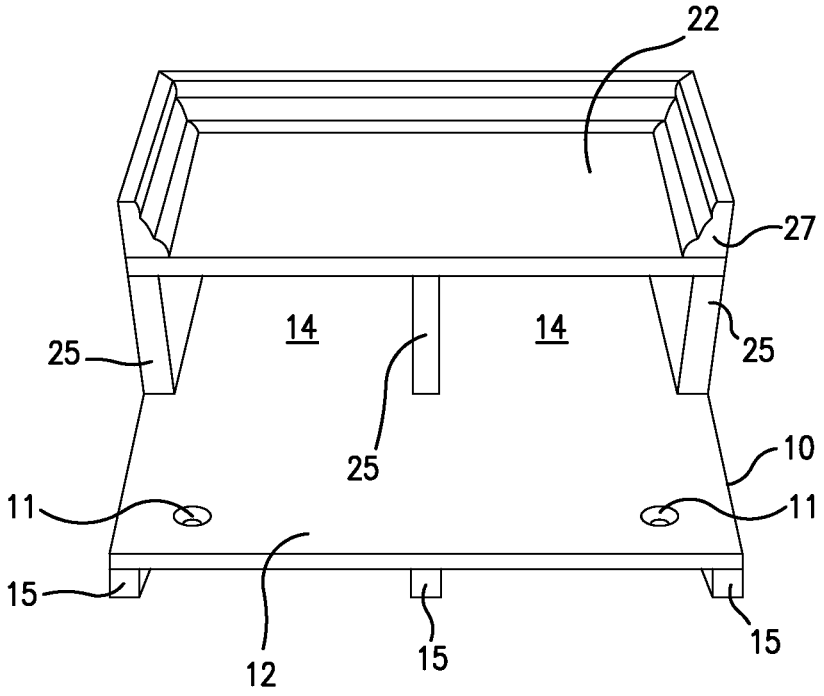
FIG. 1 is a front, perspective view of a first embodiment of a step stool comprising open, forwardly facing storage cubbies and two steps.
Figure 2:
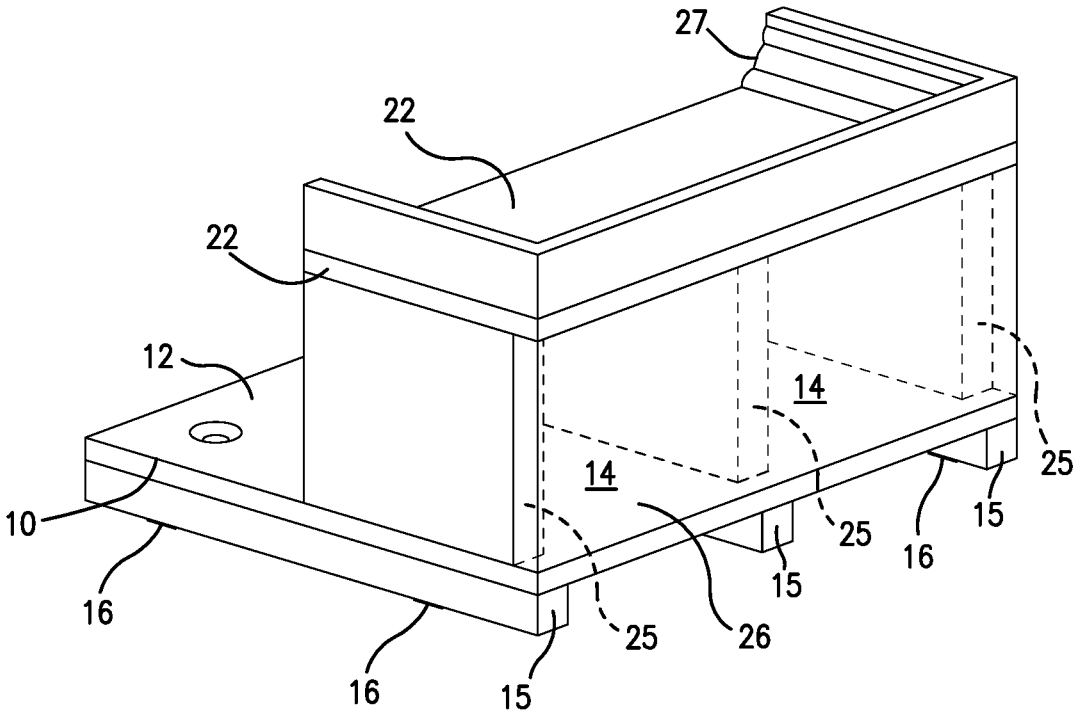
FIG. 2 is a rear, perspective view of the first embodiment of a step stool shown in FIG. 1.
Figure 3:
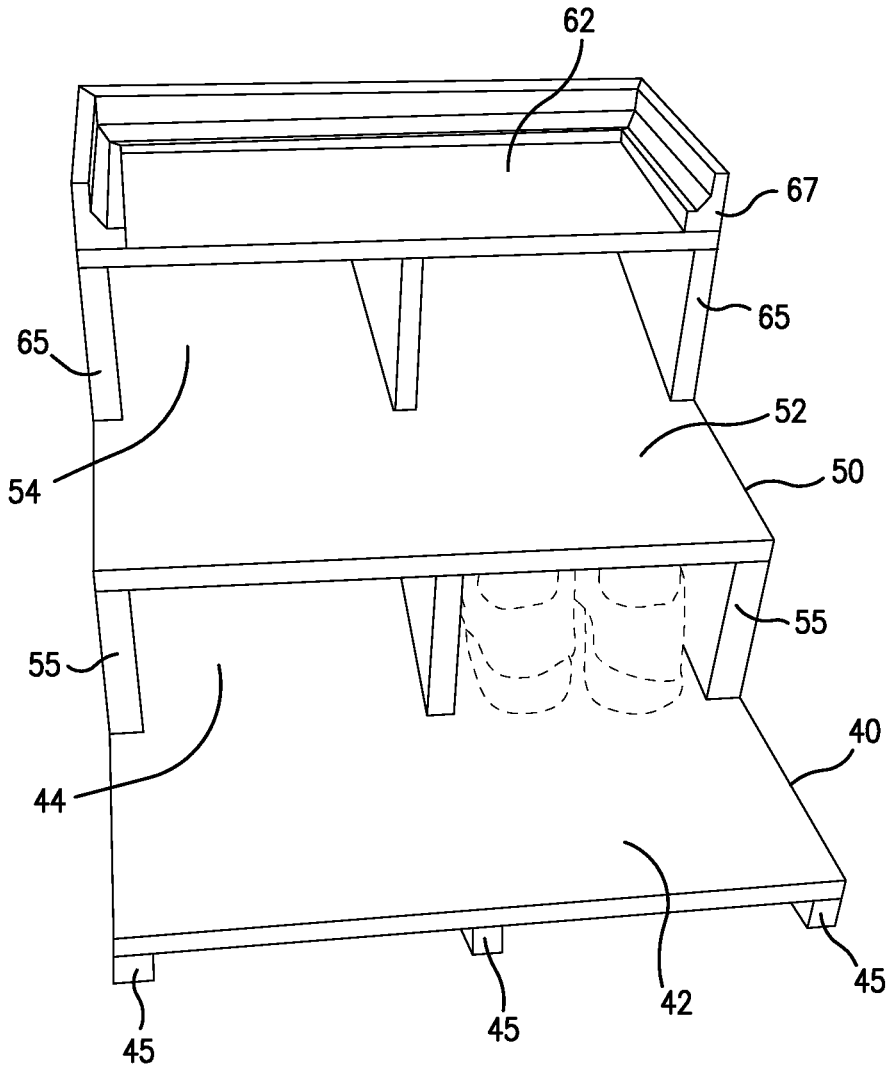
FIG. 3 is a front, perspective view of a second embodiment of a step stool comprising open, forwardly facing storage cubbies, three steps and an open back.

FIGS. 1 and 2 are front and rear perspective views of a first embodiment of a step stool comprising two open, forwardly facing storage cubbies. In this embodiment, a base 10 comprises a forward, exposed tread portion 12 and a rearward covered, portion 14. As used herein, for purposes of convention, shoes or other items are inserted and removed from the "front" or "forwardly facing" portions of the storage cubbies. References to "right" and "left" are from the perspective of a person standing in front of the step stool or storage, step support and facing the front of the stool or step support. For example, the shoes shown in phantom in FIG. 3 are on the right side of base 40. The term "tread" is used to indicate the part of a step that is stepped upon. The term "riser" indicates the distance from the top of one tread to the top of the next tread, measured vertically. The lowest portion of a stool or storage, step support is sometimes referred to herein as the "lower surface".

Base 10 is supported and elevated off the floor by three lower supports 15. In this embodiment, friction reducing devices 16, such as "Magic Sliders®" are optionally disposed on the bottoms of lower supports 15 to facilitate sliding the step stool on a surface. Forward exposed portion 12 forms a lower tread. In this embodiment, lower tread 12 is about 2 inches above the surface on which the step stool rests. Alternatively, lower tread 12 can be closer to that surface or higher above it such as about 3 inches above the surface. Lower tread is not greater than 8 inches above the surface. An upper tread 22 is supported above rearward covered portion 14 of base 10 by three upper supports 25. The supports are sufficiently strong to collectively provide a load carrying capacity of at least 150 pounds, preferably at least 250 pounds, and most preferably at least 350 pounds to each of the treads 12, 22 which they support.

The upper supports 25, rearward covered portion 14 and upper tread 22 define two storage cubbies which are preferably dimensioned to store a pair of adult shoes. Each storage area preferably has a width of 8 inches, but can have other widths such as, for example, 6 inches, 4 inches, 3 inches and 1 inch. Each storage area preferably has a depth of about 12 inches, but can have depths of other dimensions such as 11 inches, 9 inches, or 7 inches. The forward facing opening of the storage areas, e.g. shoe cubbies, is most preferably entirely open to permit easy access to the shoes and to facilitate placement of shoes or other items into the cubbies. The forward facing openings can also be substantially open. As used herein, the term "substantially open" indicates that at least 80% of the forward portion of the storage area is unobstructed.

Upper tread 22 is not more than 8 inches above lower tread 12, and in various embodiments is 8 inches above lower tread 12, about 6 inches above lower tread 12, about 4 inches above lower tread 12, and about 3 inches above lower tread 12. Base 10 of this illustrated embodiment also comprises two holes 11 in the forward exposed portion in order to facilitate gripping by a user when pulling the step stool to a different location. Other embodiments had a lower tread which does not have any holes or depressions.

In order to facilitate the optional storage of shoes or other items on upper tread 22, and to reduce the likelihood that such items would fall off upper tread 22, a rim 27 is positioned proximate the side and rear edges of upper tread 22. In the illustrated embodiment, rim 27 is formed of a decorative molding, but other rims of different shapes and sizes can be utilized. Additionally, a rear wall 26 (best shown in FIG. 2) prevents items from falling out the rear of the storage areas and provides further vertical support to upper tread 22.

As best shown in FIG. 2, upper supports 25 and rear wall 26 rest on the rearward covered portion 14 of base 10 which is resting on lower supports 15. Lower supports 15 preferably extend from the front edge of base 10 rearwardly at least to the rear edge of base 10.

Figure 4:
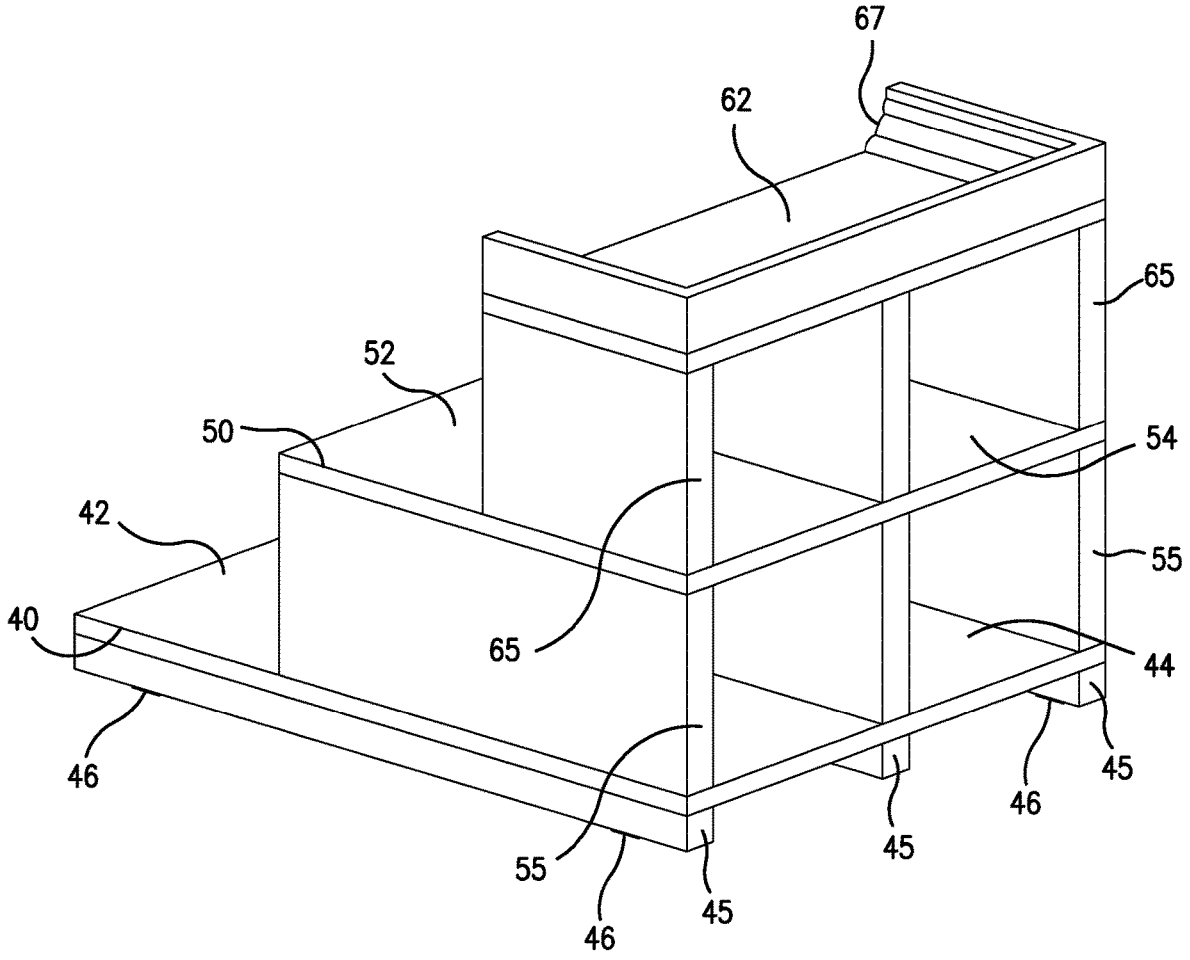
FIG. 4 is a rear perspective view of the second embodiment of a step stool shown in FIG. 3.

FIGS. 3 and 4 are front and rear perspective views, respectively, of a second embodiment of a step stool comprising two open, forwardly facing storage areas or cubbies on each of two storage levels. In this embodiment, a lower base 40 comprises a forward exposed tread portion 42 and a rearward covered, portion 44. Base 40 is supported and elevated off the floor by three lower supports 45. An upper base 50 is supported above lower base 40 by intermediate supports 55. Similar to lower base 40, intermediate base 50 comprises a forward exposed tread portion 52 and a rearward covered, portion 54. Forward exposed tread portions 42 and 52 are treads on which a person can stand. Furthermore, an upper tread 62 is supported above rearward covered portion 54 of base 50 by three upper supports 65 and is designed to support a standing adult. All sets of supports are sufficiently strong to collectively provide a load carrying capacity of at least 150 pounds, preferably at least 250 pounds, and most preferably at least 350 pounds to the treads they support. This step stool is intended to support one person at any time, not a person on each step.

As in the first embodiment described above, the supports, rearward covered portions and upper treads define storage cubbies which are preferably dimensioned to accommodate a pair of adult shoes. For example, each individual storage area preferably has a width of at least about 8 inches, and a depth of at least 11 inches. The forward facing opening of these storage areas is preferably entirely open to permit easy access to the shoes and to facilitate placement of shoes or other items into the cubbies. If not entirely open, the forwardly facing access is preferably substantially open.

In order to facilitate the optional storage of shoes or other items on upper tread 62, and to reduce the likelihood that such items would fall off upper tread 62, a rim 67 is provided proximate the side and rear edges of upper tread 62. In the illustrated embodiment, rim 67 is formed of a decorative molding, but other rims of different shapes and sizes can be utilized.

As best shown in FIG. 4, upper supports 65 rest on the rearward covered portion 54 of base 50 which is resting on intermediate supports 55, which in turn are resting on lower base 40 which sits on lower supports 55. Lower supports 45 also preferably extend from the front edge of base 40 rearwardly at least to the rear edge of base 40. This illustrated embodiment comprises two cubbies on each of two storage levels. This embodiment does not have a back wall corresponding to rear wall 26 of the embodiment of FIGS. 1 and 2. Lower tread 40 also does not have grip holes. The top surface of lower tread 40 is substantially level.

While it is preferred that upper tread 62 is designed so support a standing person, in alternative embodiments, similar to the embodiment shown in FIGS. 3 and 4, the uppermost storage surface may be designed for storage only and not sufficiently strong to support the weight of a person.

Figure 5:
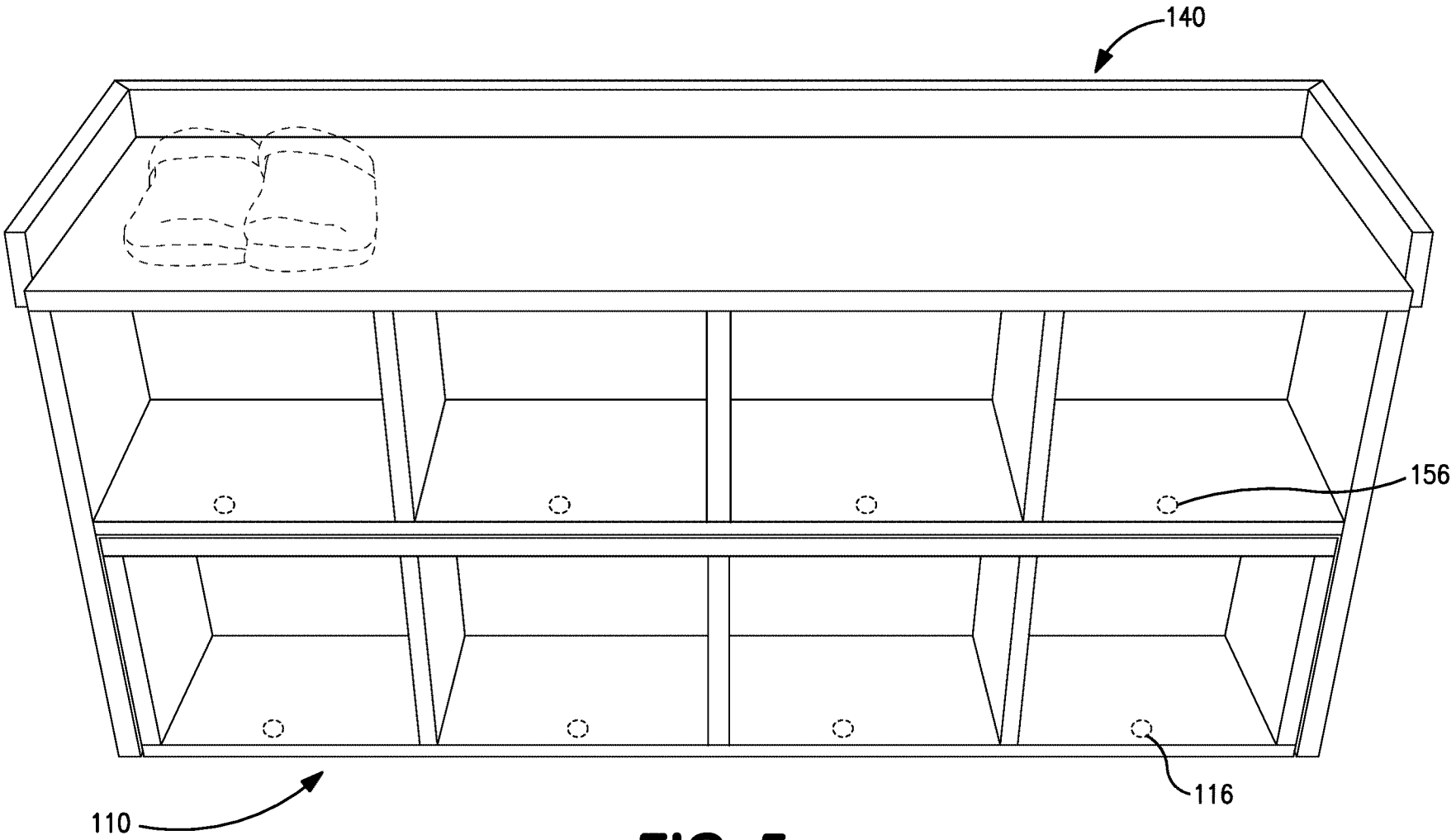
FIG. 5 is a front, perspective view of storage, step support with a movable, lower step in the storage position.
Figure 6:
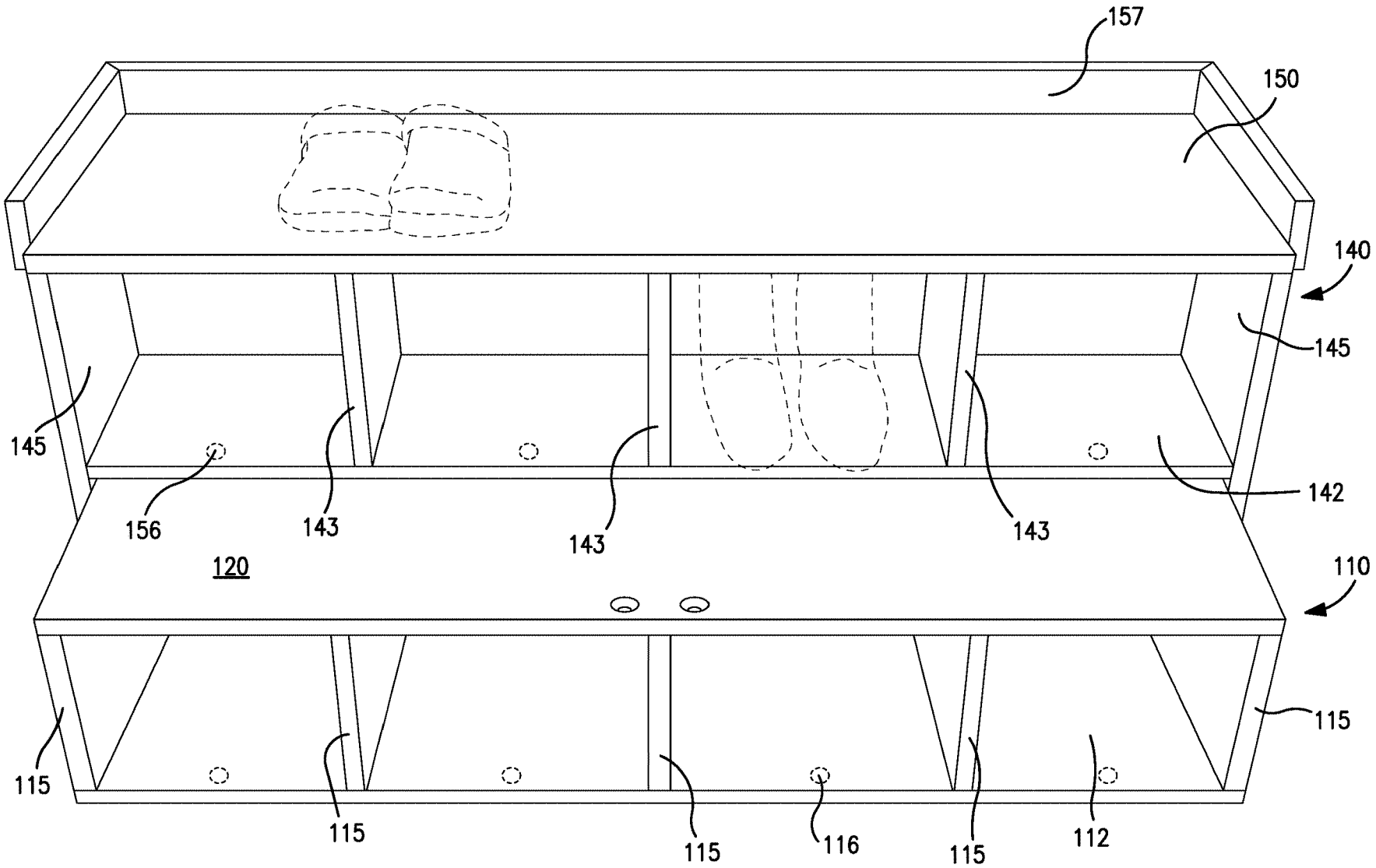
FIG. 6 is a front, perspective view of the storage, step support shown in FIG. 5 with the movable, lower step in the extended "step" position.

FIGS. 5-11 illustrate storage, step support comprising a movable lower step 110 and an upper step 140. FIG. 5 shows lower step 110 in the retracted "storage" position and FIG. 6 shows lower step 110 in the extended "step" position.

The lower step 110 is movably connected to the upper step 140 for movement from a storage position where at least a substantial portion of the lower tread 120 is positioned below the upper base 142 so that said lower tread 120 is not accessible to use as a step to a step position where a sufficient portion of the lower tread 120 is positioned forwardly of the upper base 142 and is accessible for use as a step.

With reference to FIG. 6, lower step 110 comprises a base 112, five vertical supports 115, and a lower tread 120 positioned above base 112 and supported by the five supports 115. The base 112, supports 115 and lower tread 120 collectively define four lower level storage areas. These storage areas are open in the forward facing direction to provide ready access to shoes or other items stored in them. While preferably entirely open, the storage areas could alternatively be substantially open.

Upper step 140 also has a row of four storage areas in an upper level storage defined by an upper base 142, three inner upper supports 143, two outer upper supports 145 and an upper tread 150. The outer upper supports 145 which are located on the right end and left end of upper step 140, respectively, extend down as far as the bottom of lower base 112 to transfer some of the load received by upper tread 150 directly to the floor. The rear, left and right edges of upper tread 150 in this illustrated embodiment are advantageously provided with a raised rim 157 to prevent items from falling off the top of upper tread 150. Such items are preferably only stored on upper tread 150 when upper tread 150 is not being used as a step.

Lower step 110 and upper step 140 are preferably dimensioned so that there is minimal clearance between the bottom of upper base 142 and the top of lower tread 120 so that when a person stands on upper tread 150, the center of upper step 140 will deflect to a small degree, but sufficiently to rest upon the top of lower step 110, i.e. on lower tread 120. The inner upper supports 143 transfer the load from upper tread 150 through upper base 142 onto lower tread 120. The lower supports 115 transfer loads on lower tread 120 to lower base 112 which transfers the load to the floor. With this preferred construction, the full load applied to upper tread 150 is not carried by outer upper supports 145, but is shared by inner upper supports 143 and lower step 110.

Lower tread 120 is preferably not more than 8 inches above the lower surface of base 112, and in various embodiments is 8 inches above the lower surface of base 112, about 6 inches above the lower surface of base 112, about 4 inches above lower surface of base 112, and about 3 inches above lower surface of base 112. Upper tread 150 is preferably not more than 8 inches above the lower tread 120, and in various embodiments is 8 inches above the lower tread 120, about 6 inches above the lower tread 120, about 4 inches above lower tread 120, and about 3 inches above lower tread 120. Each tread preferably has a depth of about 12 inches, but can have depths of other dimensions such as, for example, 11 inches, 9 inches, or 7 inches.

Figure 7:
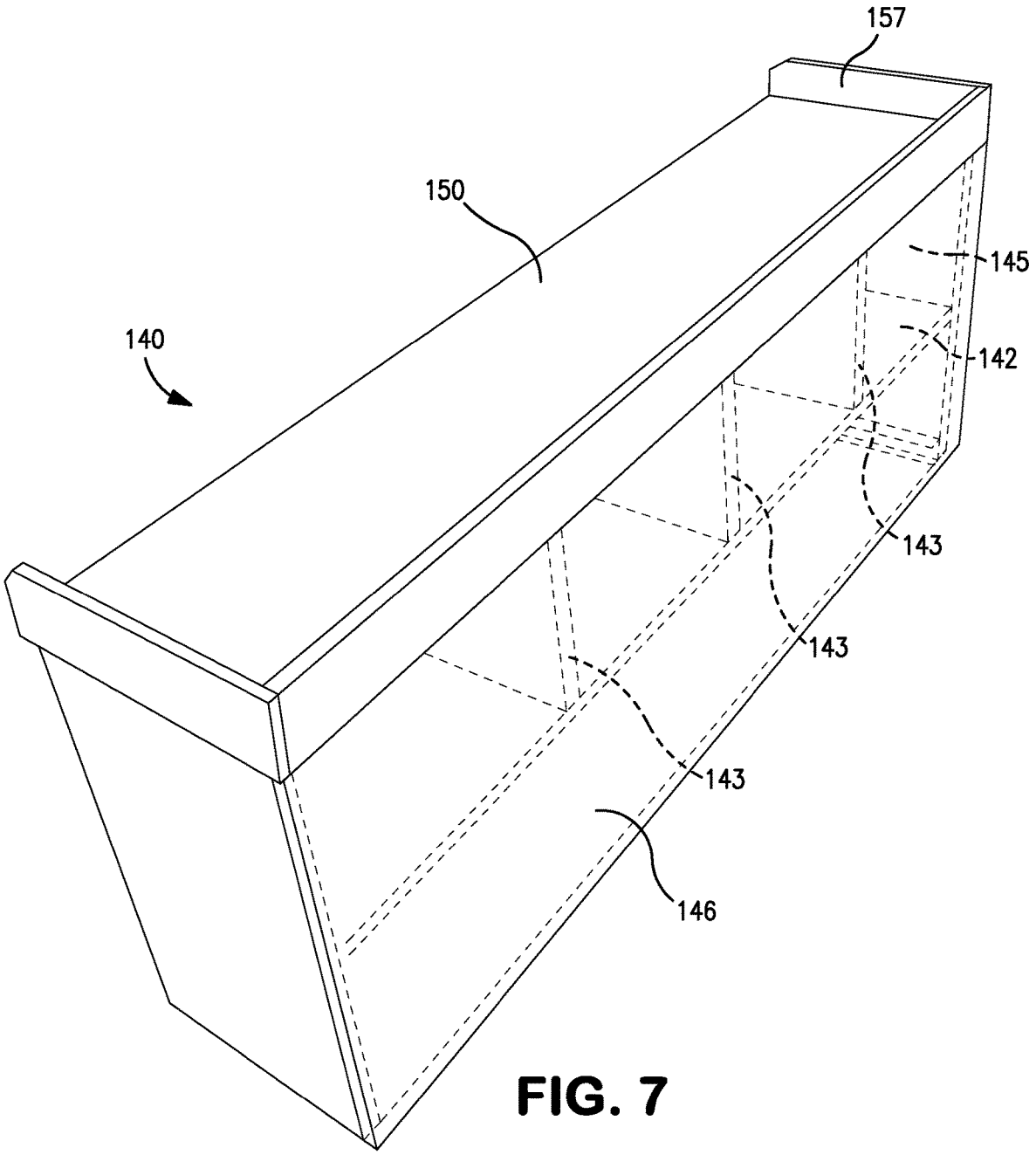
FIG. 7 is a rear, perspective view of the top step of the storage, step support shown in FIG. 5.

FIG. 7 is a rear perspective view of top step 140 showing rear wall 146. Upper inner supports 143 and upper base 142 are shown in phantom.

Figure 8:
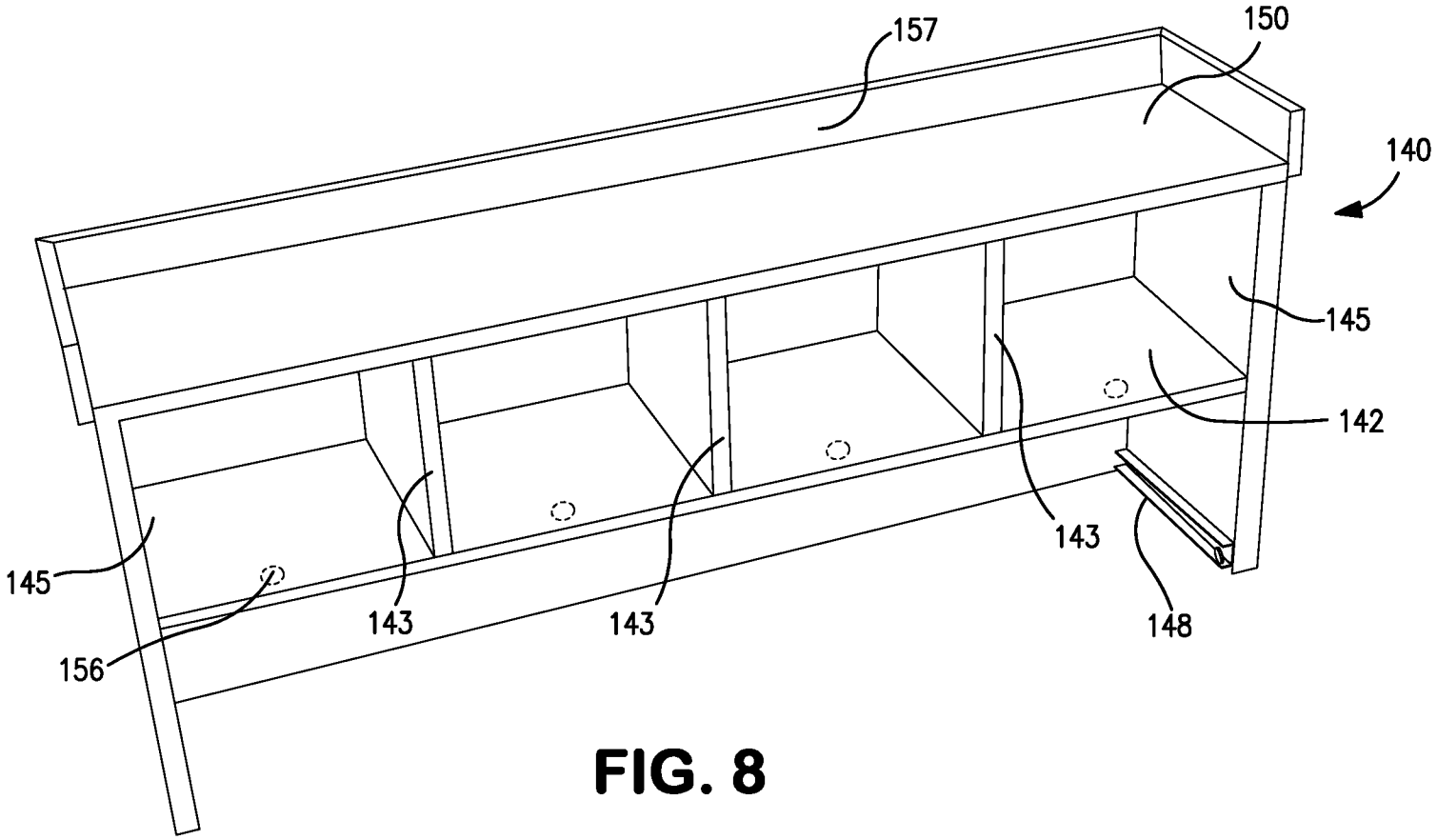
FIG. 8 is a front, perspective view of the top step of the storage, step support shown in FIG. 5.
Figure 9:
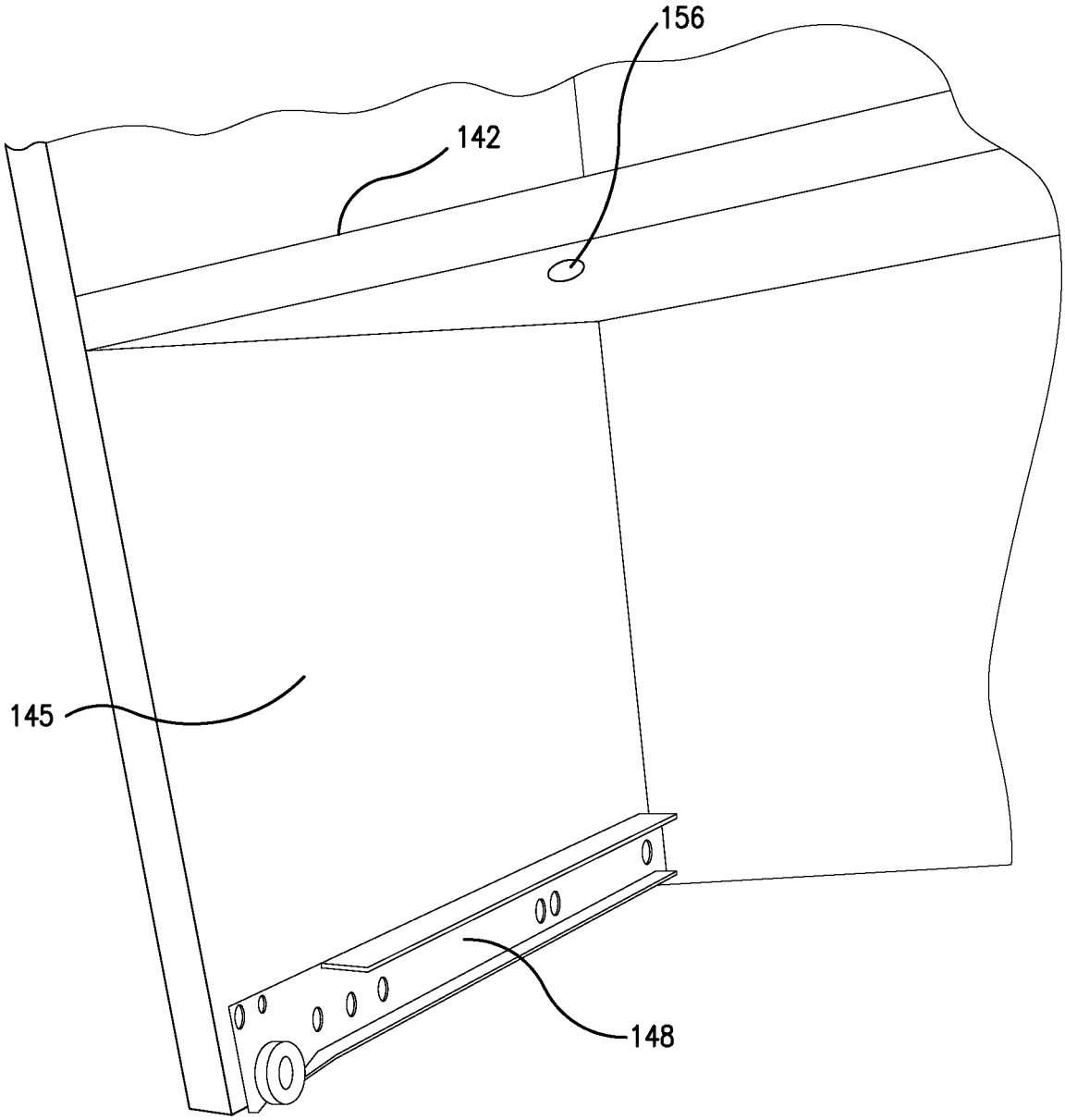
FIG. 9 is a partial, close-up, front perspective view of the upper step of the storage, step support shown in FIG. 5.
Figure 10:
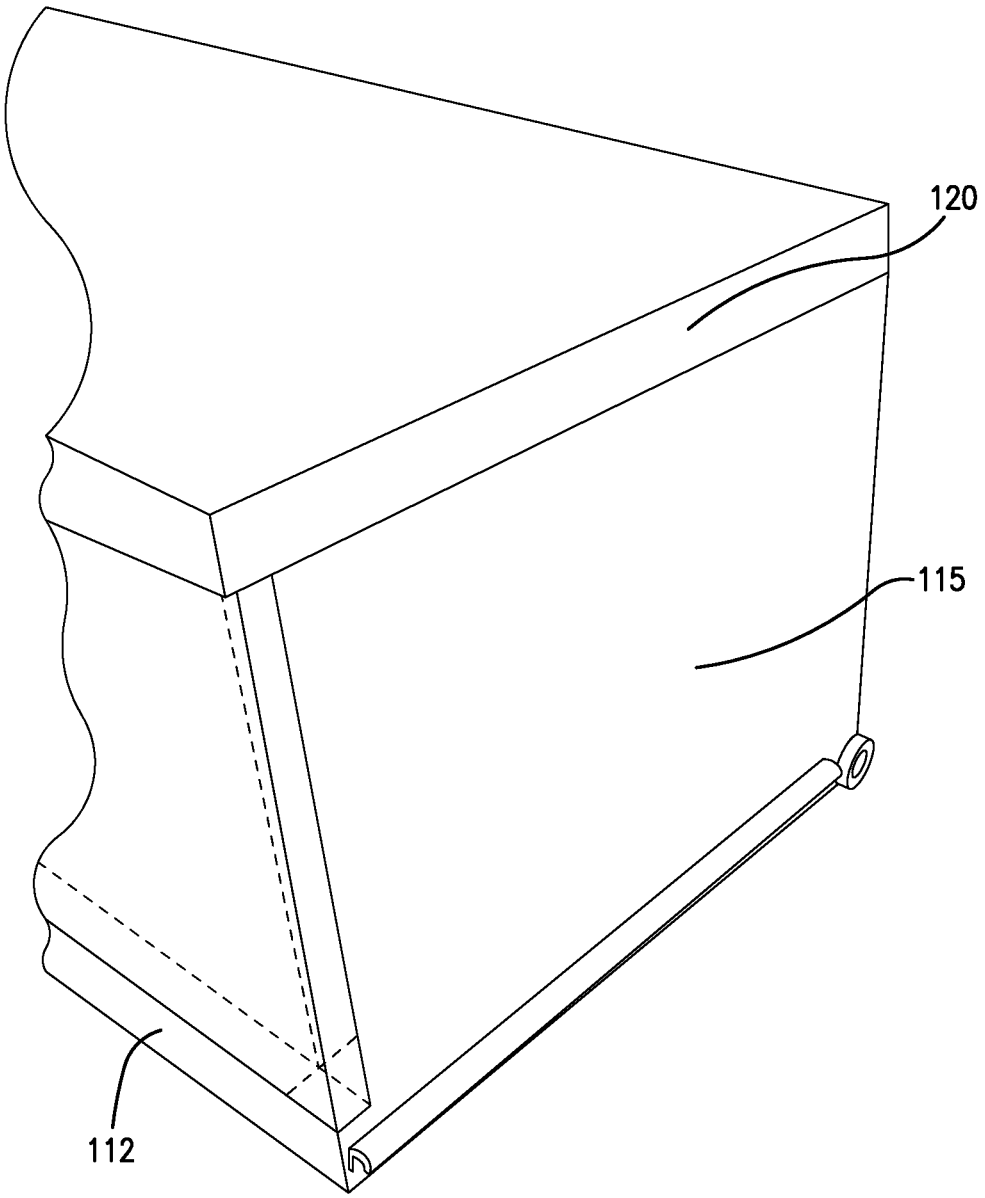
FIG. 10 is a partial, rear, perspective view of the lower step of the storage, step support shown in FIG. 5.
Figure 11:
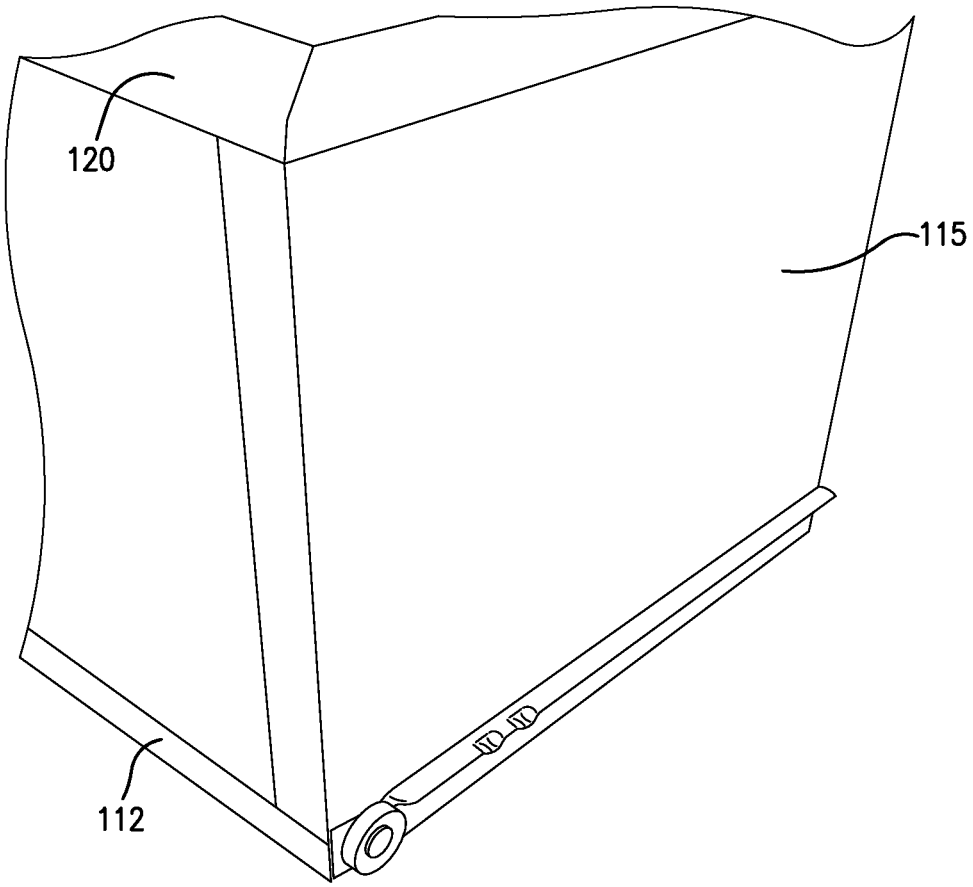
FIG. 11 is a partial, front, perspective view of the lower step of the storage, step support shown in FIG. 5.
Figure 12:
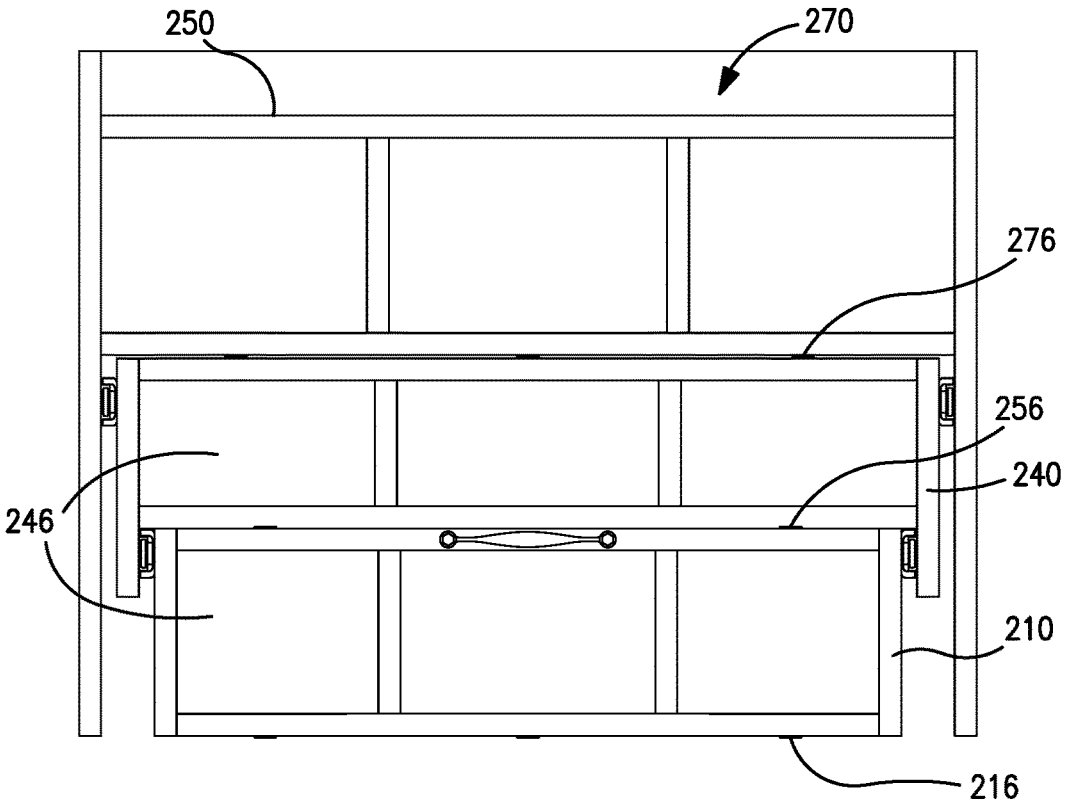
FIG. 12 is a front view of storage, step support comprising two movable steps.
Figure 13:
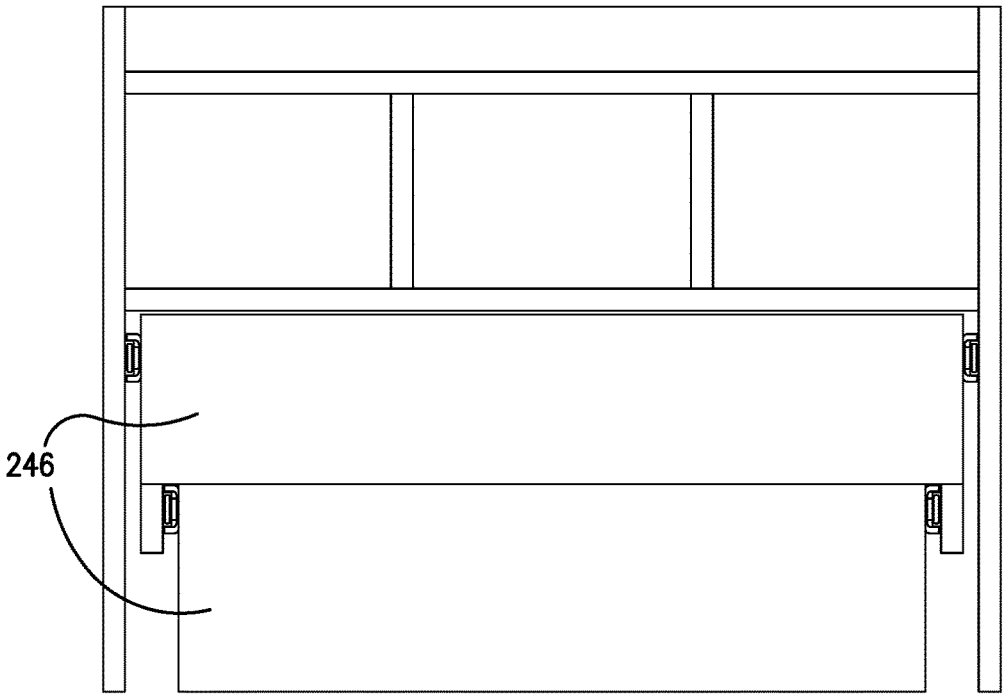
FIG. 13 is a rear view of the storage, step support shown in FIG. 12 (with the rear walls removed).

FIG. 8 is a front perspective of top step 140 showing one of the drawer sliders 148 which movably connects lower step 110 to upper step 140 and facilitates the smooth movement of the lower step 110 from the storage position to the step position. FIG. 9 is a close-up view of an exemplary drawer slider 148 while FIGS. 10 and 11 are partial front and rear perspective views, respectively, of the complementary portion 149 of the drawer slider 148 secured to the outer side of lower step 110. By way of example, draw slides sold under model no. FR 5043 by Sulterer USA, Inc. of High Point, N.C., USA have been found suitable for connecting relatively movable steps of the various embodiments disclosed. Additionally, friction reducing devices 116, 156 can be positioned on the bottoms of bases 112 and 142, respectively to further facilitate their movement if desired.

FIGS. 12-16 illustrate storage, step support comprising two movable steps 210, 240 which are movable in a telescoping fashion relative to an upper storage area 270. This embodiment is similar to the embodiment described with reference to FIGS. 5-11 with the following exceptions. The storage, step support of this embodiment is intended to stay up against the rear wall of a storage closet. The rear wall 246 can advantageously be secured to the inner, rear wall of storage closet. Therefore, uppermost storage surface 250 is not intended to be a tread since an adult standing on the uppermost storage surface would likely bump their head on the closet shelf. In an alternative embodiment, however, the uppermost storage surface is sufficiently supported to serve as a tread for adults.

The rearward and side edges of uppermost storage surface 250 in this illustrated embodiment are advantageously provided with a raised rim 257 to prevent items from falling off the top of uppermost storage surface 250.

Figure 14:
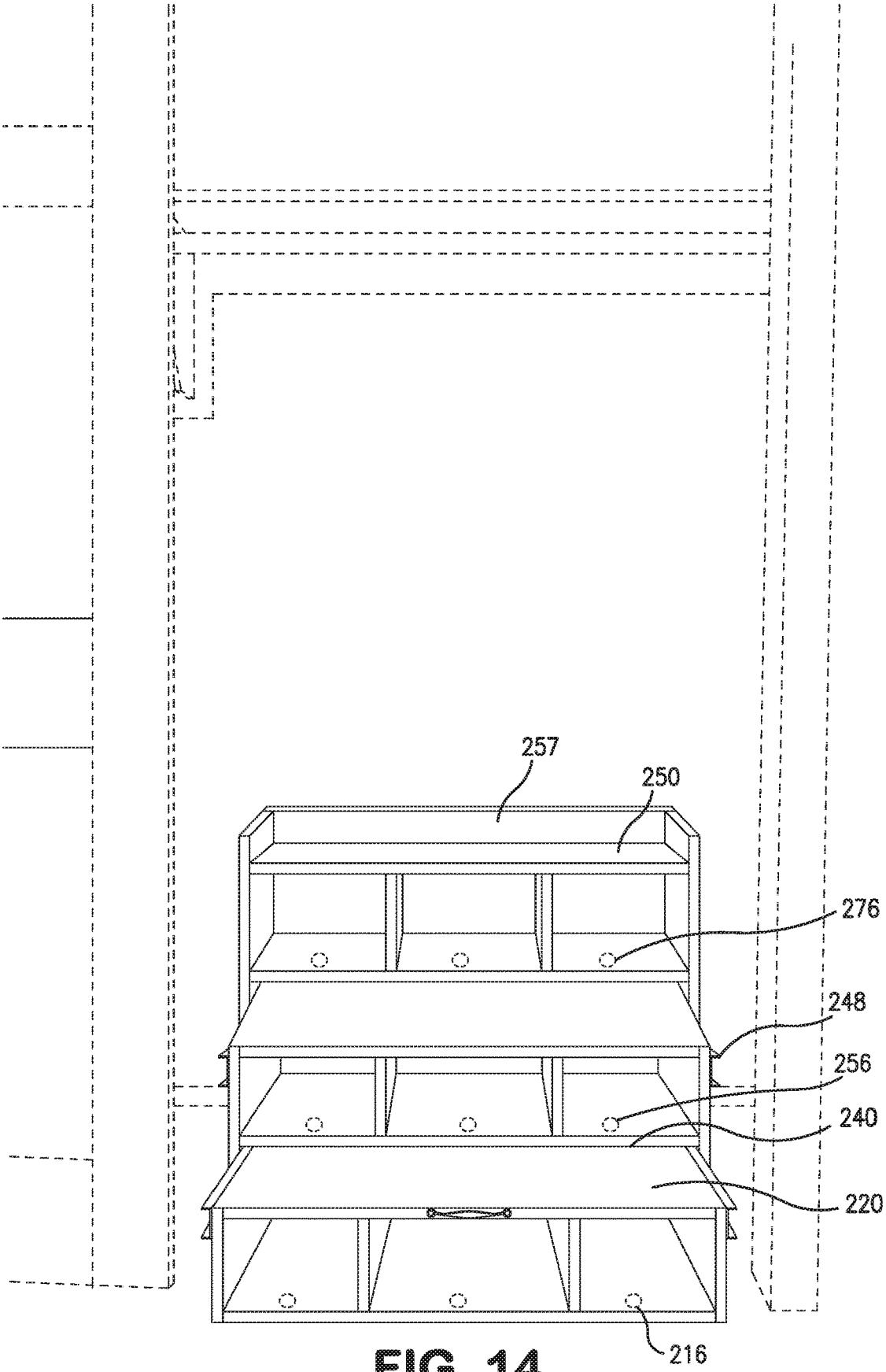
FIG. 14 is a front, perspective view of the storage, step support shown in FIG. 12 positioned in a closet (shown in phantom) and with the lower steps extended.
Figure 15:
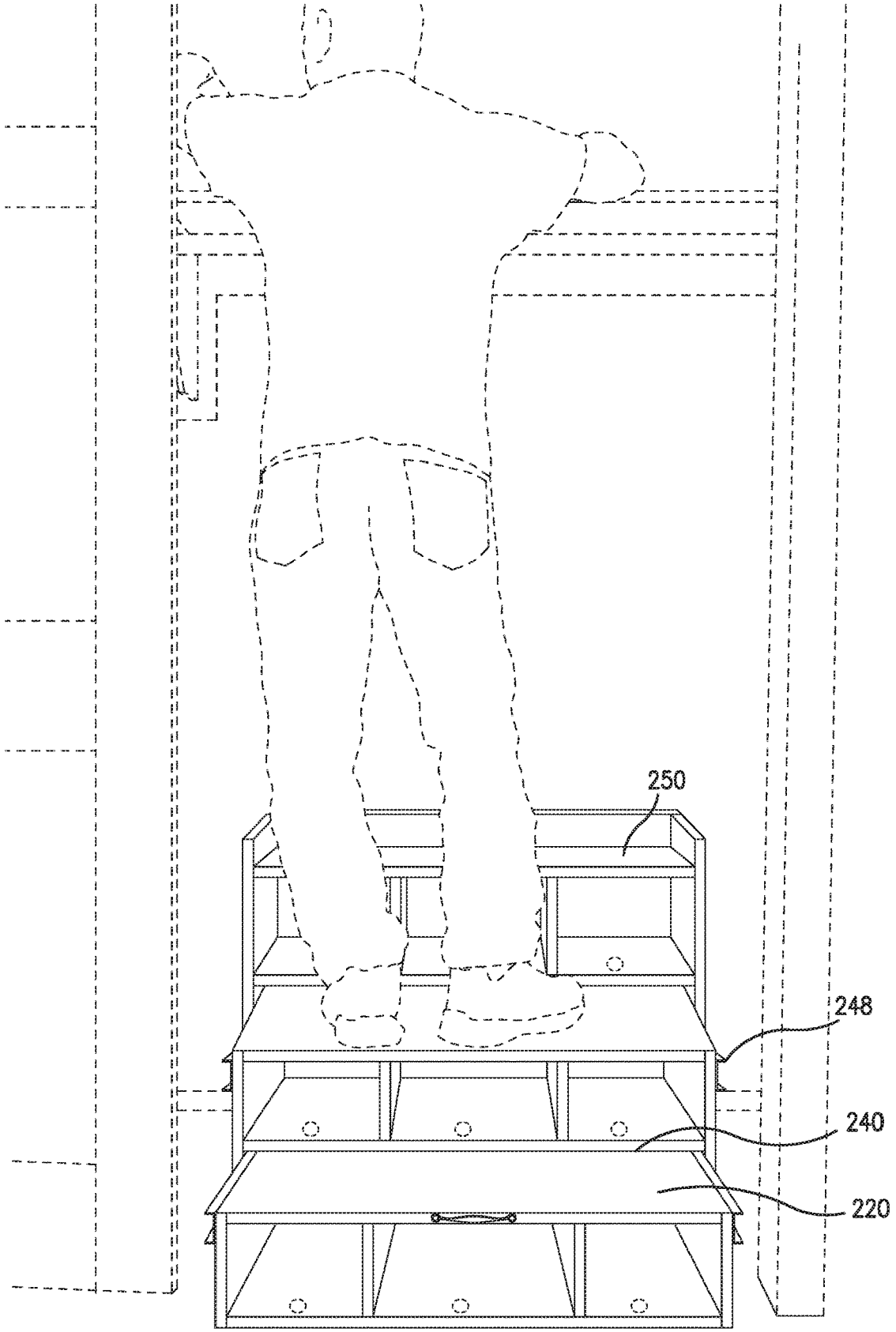
FIG. 15 is a front, perspective view of the storage, step support shown in FIG. 12 positioned in a closet (shown in phantom) with the lower steps extended and with a person (also shown in phantom) using the steps.
Figure 16:
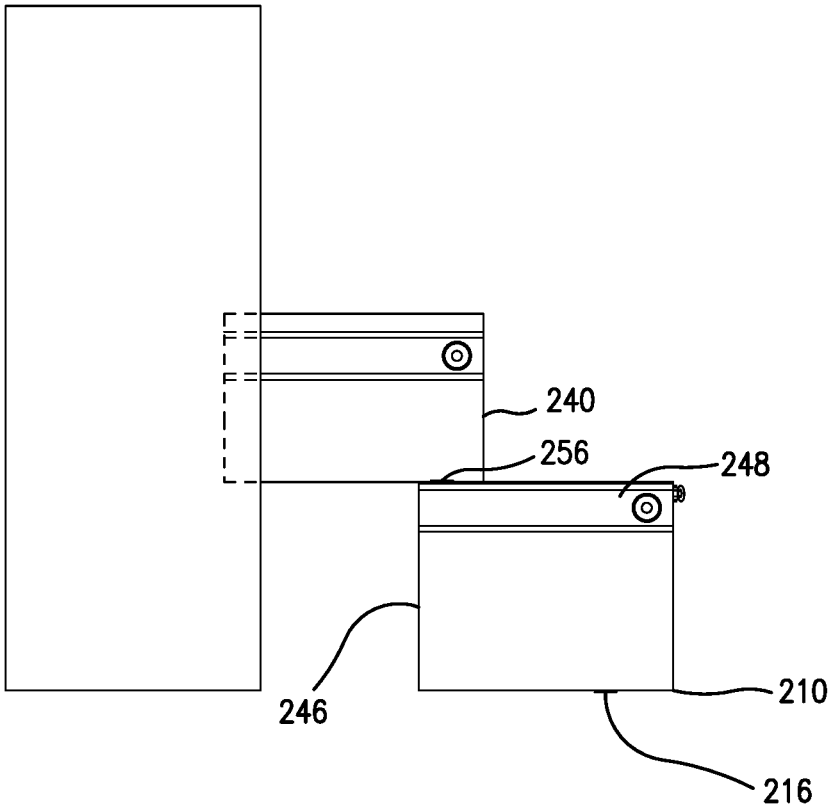
FIG. 16 is a side view of the storage, step support shown in FIG. 12 with the lower steps extended.

With reference to FIG. 16, when both steps 210 and 240 are in their extended step positions, lower step 210 rests on the floor and likely extends out of the closet as shown in FIGS. 14 and 15. The forward portion of intermediate step 240 rests on lower tread 220 while the rearward portion of intermediate step 240 is supported by a drawer slide 248. Additionally, in this illustrated embodiment, the upper level storage areas do not have a rear wall since the back of this storage step support is intended to abut a wall of a closet.

Additionally, friction reducing devices 216 can be positioned on the bottom of bases 216, friction reducing devices 256 can be positioned between the second base and the first tread, and friction reducing devices 276 can be positioned between the third base and the second tread to further facilitate their movement if desired.

The invention claimed is:

1. A storage, step support comprising storage spaces for storing articles other than portions of the step support, comprising:

a first step comprising a first tread, a first base and a plurality of first supports supporting said first tread above and in spaced relation to said first base;

said first tread, said first base and said first supports defining at least one first level storage space, said at least one first level storage space comprising an open, forwardly facing access;

a second step comprising a second tread, a second base and a plurality of second supports supporting said second tread above and in spaced relation to said second base;

said second tread, said second base and said second supports defining at least one second level storage space, said at least one second level storage space comprising an open, forwardly facing access; and said first step is movably connected to said second step for movement from a storage position where at least a substantial portion of said first tread is positioned below said second base so that said first tread is not accessible to use as a step to a step position where a portion of said first tread is positioned forwardly of said second base and is accessible for use as a step.

2. A storage, step support according to claim 1 wherein said plurality of first supports comprises at least three first supports and said at least one first level storage space comprises a plurality of first level storage spaces.

3. A storage, step support according to claim 2 wherein at least one of said first supports is generally centrally positioned along the width of said first base.

4. A storage, step support according to claim 2 wherein said plurality of second supports comprises at least three second supports and said at least one second level storage space comprises a plurality of second level storage.

5. A storage, step support according to claim 1 comprising a raised rim along at least one edge of said second tread.

6. A storage, step support according to claim 5 comprising a raised rim along the rearward edge and side edges of said second tread.

7. A storage, step support according to claim 1 further comprising at least one friction reducing element positioned between said second base and said first tread.

8. A storage, step support according to claim 1 wherein said plurality of second supports collectively provide said second tread with at least 150 pounds of load carrying capacity.

9. A storage, step support according to claim 1 wherein said plurality of second supports collectively provide said second tread with at least 250 pounds of load carrying capacity.

10. A storage, step support according to claim 1 wherein said plurality of second supports collectively provide said second tread with at least 350 pounds of load carrying capacity.

11. A storage, step support according to claim 1 wherein at least two of said second supports extend downwardly as far as the bottom of the lower base.

12. A storage, step support according to claim 1 wherein said second tread is not greater than 8 inches higher than said first tread.

13. A storage, step support according to claim 1 wherein said first base comprises a lower surface and said first tread is not greater than 8 inches higher than said lower surface of said first base.

14. A storage, step support according to claim 1 further comprising a third step;

said third step comprising a third tread, a third base and a plurality of third supports supporting said third tread above and in spaced relation to said third base;

said third tread, said third base and said third supports defining at least one third level storage space, said at least one third level storage space comprising an open, forwardly facing access; and said second step is movably connected to said third step for movement from a storage position where at least a substantial portion of said second tread is positioned below said third base so that said second tread is not accessible to use as a step, to a step position where a portion of said second tread is positioned forwardly of said third base and is accessible for use as a step.

15. A storage, step support according to claim 14 wherein said third tread comprises a rearward edge and side edges, said third tread further comprises a raised rim along at least one of said rearward edge and side edges of said third tread.

16. A storage, step support according to claim 14 wherein said third tread comprises a rearward edge comprising a raised rim and side edges comprising a raised rim.

17. A storage, step support according to claim 14 wherein said third tread is not greater than 8 inches higher than said second tread.

18. A storage, step support according to claim 14 further comprising at least one friction reducing element positioned between said third base and said second tread.

19. A storage, step support according to claim 1 wherein at least one of said treads has a width of at least 20 inches.

20. A storage, step support according to claim 1 wherein each storage space has a depth of at least 10 inches.

21. A storage, step support according to claim 1 wherein each storage space has a height of at least 5 inches.

22. A storage, step support comprising:

a first step comprising a first tread, a first base and a plurality of first supports supporting said first tread above and in spaced relation to said first base;

said first tread, said first base and said first supports defining at least one first level storage space, said at least one first level storage space comprising an open, forwardly facing access;

a second step comprising a second tread, a second base and a plurality of second supports supporting said second tread above and in spaced relation to said second base;

said second tread, said second base and said second supports defining at least one second level storage space, said at least one second level storage space comprising an open, forwardly facing access; and said first step is movably connected to said second step for movement from a storage position where at least a substantial portion of said first tread is positioned below said second base so that said first tread is not accessible to use as a step to a step position where a portion of said first tread is positioned forwardly of said second base and is accessible for use as a step;

said third step comprising a third tread, a third base and a plurality of third supports supporting said third tread above and in spaced relation to said third base;

said third tread, said third base and said third supports defining at least one third level storage space, said at least one third level storage space comprising an open, forwardly facing access;

said second step is movably connected to said third step for movement from a storage position where at least a substantial portion of said second tread is positioned below said third base so that said second tread is not accessible to use as a step, to a step position where a portion of said second tread is positioned forwardly of said third base and is accessible for use as a step; and wherein said plurality of second supports collectively provide said second tread with at least 150 pounds of load carrying capacity.

* * * * *